US007048508B2

(12) United States Patent
Bachofner et al.

(10) Patent No.: US 7,048,508 B2
(45) Date of Patent: May 23, 2006

(54) ROTOR END PIECE

(75) Inventors: René Bachofner, Neuenhof (CH); Pietro Grigioni, Oberehrendingen (CH); Wolfgang Kappis, Fislisbach (CH)

(73) Assignee: ALSTOM Technology Ltd., Baden (CH)

( * ) Notice: Subject to any disclaimer, the term of this patent is extended or adjusted under 35 U.S.C. 154(b) by 75 days.

(21) Appl. No.: 10/792,707

(22) Filed: Mar. 5, 2004

(65) Prior Publication Data

US 2004/0179944 A1 Sep. 16, 2004

(30) Foreign Application Priority Data

Mar. 11, 2003 (DE) ..... 103 10 431

(51) Int. Cl.
*F01D 5/32* (2006.01)

(52) U.S. Cl. ..... 416/215; 416/220 R; 416/204 A

(58) Field of Classification Search ..... 416/215, 416/219 R, 220 R, 204 A
See application file for complete search history.

(56) References Cited

U.S. PATENT DOCUMENTS 2,857,134 A * 10/1958 Arkless ..... 416/216
6,299,411 B1 * 10/2001 Freuschle et al. ..... 416/215

FOREIGN PATENT DOCUMENTS

| | | |
|---|---|---|
| CH | 349624 | 12/1960 |
| GB | 116517 | 6/1918 |

OTHER PUBLICATIONS

Search Report from DE 103 10 431.3 (Mar. 11, 2003).

* cited by examiner

*Primary Examiner*—Ninh H. Nguyen
(74) *Attorney, Agent, or Firm*—Cermak & Kenealy, LLP; Adam J. Cermak

(57) ABSTRACT

A rotor end piece (1) for rotors (2) of thermal turbomachines is provided with circumferential slot (3), including two end piece halves (4, 4') having side faces (5, 5') opposite one another in the installed state and top surfaces (6, 6') adjoining one another. The rotor end piece (1) side faces (5, 5') of the end piece halves (4,4') are connected to one another in a form-fitting manner. To this end, the side faces (5, 5') are designed in such a way that a dovetail interlocking connection of the two end piece halves (4, 4') is preferably realized. The interlocked end piece halves are then secured with a weld (8). The firm anchoring of the rotor end piece (1) achieved in this way prevents detachment during operation and damage to the turbomachine caused as a result.

4 Claims, 2 Drawing Sheets

ROTOR END PIECE

TECHNICAL FIELD

The invention relates to the field of power plant technology. It relates more particularly to a rotor end piece for rotors of thermal turbomachines and to a method of fitting the rotor end piece.

PRIOR ART

Thermal turbomachines, such as turbines and compressors, essentially comprise a rotor fitted with moving blades and a stator in which guide blades are suspended.

The task of the fixed guide blades is to direct the flow of the gaseous medium to be compressed or expanded onto the rotating moving blades in such a way that the energy conversion is effected with the best possible efficiency.

Both moving blades and guide blades essentially have an airfoil and a blade root. In order to be able to fasten the moving blades on the rotor or the guide blades in the stator, slots are recessed in the stator and on the rotor shaft. The roots of the blades are pushed into these slots and locked there.

It is known in the case of compressor rotors having circumferential slots to alternately fit moving blades and intermediate pieces in the rotor recessed portion (circumferential slot) until an opening remains in the circumferential direction, this opening being filled with a "rotor end piece". This rotor end piece consists of an intermediate piece divided in half (two end piece halves) and of a wedge. To fit the intermediate piece divided in half, a residual opening is required, which is finally closed by pushing in a wedge. The two end piece halves each have a straight side face, which at its top end forms a projecting lobe with the top surface of the end piece half. Said side faces are opposite one another in the installed state, the wedge then being located between them. Once the two end piece halves and the wedge have been installed, the lobes of the two end piece halves are finally caulked via the wedge. This known rotor end piece is supported on the rotor.

A disadvantage with this prior art is that the wedge, on account of the tilting moment of the two end piece halves, which is caused by the centrifugal force during operation, is able to bend open the caulked lobes. The wedge can thus fly out of the compressor and complete compressor damage may occur.

DESCRIPTION OF THE INVENTION

The aim of the invention is to avoid said disadvantages of the prior art. The object of the invention is to develop a rotor end piece which can be fitted in a simple manner and in which detachment during operation is prevented, so that the occurrence of compressor damage is avoided.

According to the invention, a rotor end piece for rotors of thermal turbomachines includes side faces of the end piece halves connected to one another in a form-fitting manner. The two end piece halves preferably have a dovetail interlocking connection at the dividing point.

It is expedient if the two end piece halves are locally welded to one another in the region in which the side faces and the top surfaces adjoin one another.

According to the invention, the object is achieved in the case of a method of fitting the rotor end piece in that the following steps are carried out:

a) in a first step, the first end piece half is inserted into the circumferential slot of the rotor from above,
b) in a second step, this first end piece half is displaced laterally in the circumferential slot until it is anchored in the rotor,
c) in a third step, the second end piece half is fitted next to the already installed first end piece half,
d) in a fourth step, the second end piece half is pushed into the opposite side of the circumferential slot until the first and the second end piece halves are connected to one another in a form-fitting manner, and
e) finally, in a fifth step, the two end piece halves connected in a form-fitting manner are secured by means of a weld in the region in which the side faces and the top surfaces of the end piece halves adjoin one another.

The advantages of the invention consist in the fact that the rotor end piece is firmly anchored in a form-fitting manner in the installed state. In addition, the individual parts of the rotor end piece according to the invention are simple to produce and the fitting is not more complicated compared with the known prior art.

BRIEF DESCRIPTION OF THE DRAWINGS

An exemplary embodiment of the invention is shown in the drawing, in which.

In each case the same items are provided with the same designations in the figures. The direction of movement of the parts during installation is designated by arrows.

WAYS OF IMPLEMENTING THE INVENTION

The invention is explained in more detail below with reference to an exemplary embodiment and FIGS. 1 to 3*a–e*.

Figure 1:
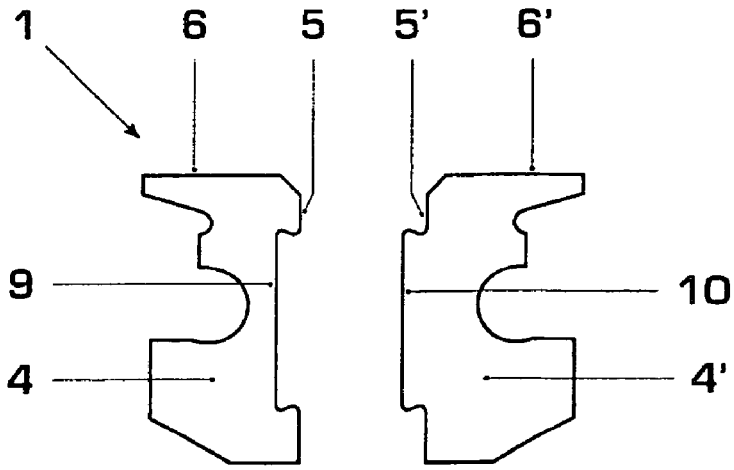
FIG. 1 shows a side view of a rotor end piece according to the invention for a compressor before installation.
Figure 2:
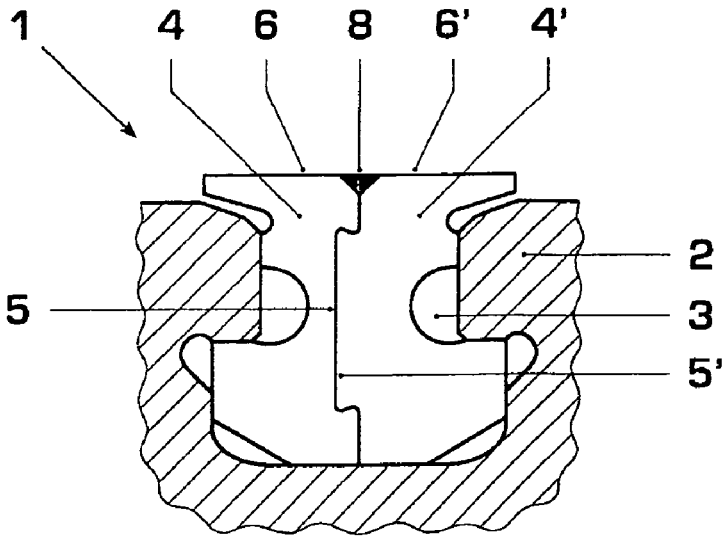
FIG. 2 shows a side view of a rotor end piece according to the invention for a compressor after installation.
Figure 3:
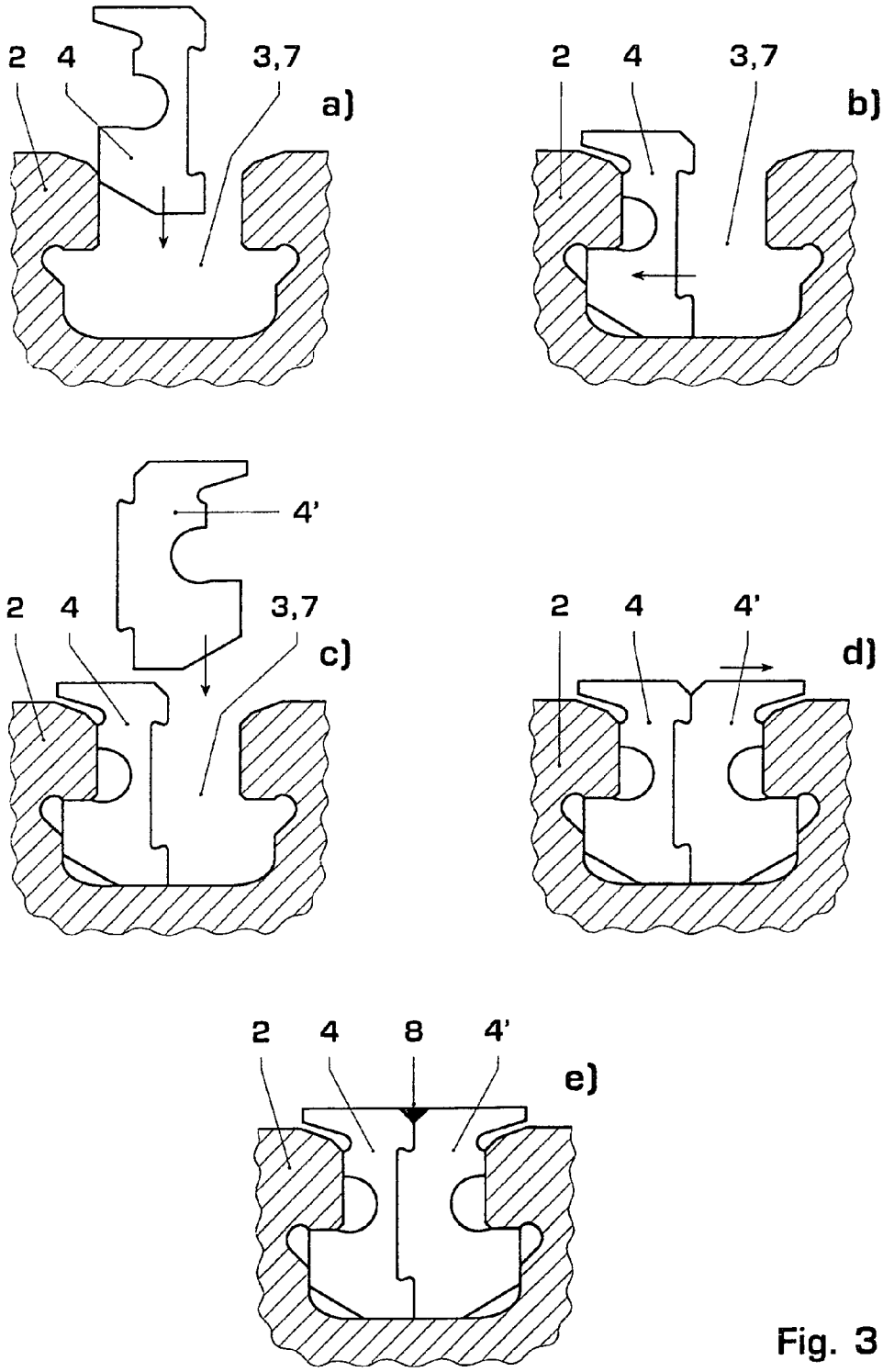
FIGS. 3*a–e* show individual steps for fitting the rotor end piece according to the invention according to FIG. 1 into the circumferential slot of the rotor.

FIG. 1 shows the side view of a rotor end piece 1 according to the invention for a compressor rotor before installation, whereas FIG. 2 shows said rotor end piece 1 after installation in the rotor 2 has been effected.

The rotor end piece 1 according to the invention consists of two end piece halves 4, 4' with a geometry which is altered compared with the known prior art. Those side faces 5, 5' of the end piece halves 4, 4' which are opposite one another in the installed state are designed in such a way that they permit a dovetail interlocking connection of the end piece halves 4, 4' which is known per se. For this purpose, the first end piece half 4 has a recess 9 in the side face 5, whereas the side face 5' of the second end piece half 4' has a projection 10 which fits accurately into this recess 9 (FIG. 1). Joining (interlocking connection) of the two parts 4 and 4' therefore leads to a form fit (FIG. 2). In order to secure the interlocked end piece halves 4, 4', a weld 8 is placed in the region in which the side faces 5, 5' and the top surfaces 6, 6' of the two end piece halves 4, 4' adjoin one another.

The operation of fitting the rotor end piece 1 is shown in FIGS. 3*a* to 3*e*. First of all, all the moving blades and intermediate pieces are fitted into the circumferential slot 3 of the compressor rotor 2 until a residual opening 7 is obtained into which only the rotor end piece 1 consisting of two end piece halves 4, 4' can be fitted. It is fitted as follows:

The first end piece half 4, in a first step, is inserted into the circumferential slot 3 from above and, in a second step, is displaced laterally in the circumferential slot 3 until it is anchored in the rotor 2. After that, the second end piece half 4', in a third step, is fitted next to the already installed first end piece half 4 and, in a fourth step, is pushed into the opposite side of the circumferential slot 3 until the two end piece halves 4, 4' are connected in a form-fitting manner. The two parts 4, 4' are thus interlocked via the dovetail. Finally, in a fifth step, the two end piece halves 4, 4' connected in a form-fitting manner are secured by means of a weld 8 in the region in which the side faces 5, 5' and the top surfaces 6, 6' of the end piece halves 4, 4' adjoin one another.

The advantages of the invention consist in the fact that the rotor end piece is firmly anchored in a form-fitting manner in the installed state. This anchoring of the rotor end piece 1 prevents detachment during operation and damage to the turbomachine caused as a result. In addition, the individual parts of the rotor end piece according to the invention are simple to produce, an additional wedge is no longer required, and the fitting is not more complicated compared with the known prior art.

The invention is of course not restricted to the exemplary embodiment described above.

LIST OF DESIGNATIONS

1 Rotor end piece
2 Rotor
3 Circumferential slot
4, 4' End piece half
5, 5' Side face of the end piece half
6, 6' Top surface of the end piece half
7 Residual opening
8 Weld
9 Recess
10 Projection

What is claimed is:

1. A rotor end piece for rotors of thermal turbomachines with a circumferential slot, the rotor end piece comprising:

two end piece halves having side faces opposite one another and top surfaces adjoining one another when positioned in an installed state;

wherein the side faces of the end piece halves are form-fittingly connected to one another; and a dovetail interlocking connection, the side faces of the two end piece halves being connected by the dovetail interlocking connection.

2. The rotor end piece as claimed in claim 1, wherein the two end piece halves are locally welded to one another in a region in which the side faces and the top surfaces of the two end piece halves adjoin one another.

3. A method of fitting a rotor end piece as claimed in claim 1 in a residual opening of a circumferential slot of a rotor, the method comprising:

in a first step, inserting a first end piece half into the circumferential slot from above;

in a second step, laterally displacing said first end piece half in the circumferential slot until it is anchored in the rotor;

in a third step, fitting a second end piece half next to the already installed first end piece half;

in a fourth step, pushing the second end piece half into a side of the circumferential slot opposite the first end piece half until the two end piece halves are connected in a form-fitting manner; and in a fifth step, securing with a weld the two connected end piece halves in the region in which the side faces and the top surfaces of the end piece halves adjoin one another.

4. The rotor end piece as claimed in claim 1, wherein the two end piece halves are locally welded to one another in a region in which the side faces and the top surfaces of the two end piece halves adjoin one another.

* * * * *